US009097099B2

(12) United States Patent
Desmette

(10) Patent No.: US 9,097,099 B2
(45) Date of Patent: Aug. 4, 2015

(54) DEVICE INCLUDING AN APPARATUS FOR MEASURING DRILLING OR CORING OPERATION PARAMETERS, AND EQUIPMENT INCLUDING SUCH A DEVICE

(75) Inventor: Sébastian Desmette, Thieusies (BE)

(73) Assignee: TERCEL IP LTD, Road Town, Tortola (VG)

( * ) Notice: Subject to any disclaimer, the term of this patent is extended or adjusted under 35 U.S.C. 154(b) by 338 days.

(21) Appl. No.: 13/142,529

(22) PCT Filed: Mar. 23, 2010

(86) PCT No.: PCT/BE2010/000021

§ 371 (c)(1),
(2), (4) Date: Jun. 28, 2011

(87) PCT Pub. No.: WO2010/108240

PCT Pub. Date: Sep. 30, 2010

(65) Prior Publication Data

US 2011/0266057 A1 Nov. 3, 2011

(30) Foreign Application Priority Data

Mar. 24, 2009 (BE) ..... 2009/0183

(51) Int. Cl.
*E21B 47/01* (2012.01)
*E21B 17/042* (2006.01)
*E21B 17/02* (2006.01)

(52) U.S. Cl.
CPC ..... *E21B 47/01* (2013.01); *E21B 17/02* (2013.01)

(58) Field of Classification Search
CPC ..... E21B 47/01; E21B 17/042
USPC ..... 175/40–50, 57, 320
See application file for complete search history.

(56) References Cited

U.S. PATENT DOCUMENTS

| | | | | |
|---|---|---|---|---|
| 2,374,197 | A * | 4/1945 | Hare | 175/41 |
| 3,183,983 | A * | 5/1965 | Vogel | 175/44 |
| 4,303,994 | A | 12/1981 | Tanguy | |
| 4,530,238 | A | 7/1985 | Hayman | |
| 4,788,544 | A * | 11/1988 | Howard | 340/853.7 |
| 5,220,963 | A | 6/1993 | Patton | |
| 5,602,541 | A | 2/1997 | Comeau et al. | |
| 6,907,944 | B2 * | 6/2005 | Sale et al. | 175/57 |
| 7,518,528 | B2 * | 4/2009 | Price et al. | 340/854.6 |
| 2008/0251292 | A1 * | 10/2008 | Desmette et al. | 175/45 |

FOREIGN PATENT DOCUMENTS

| | | | |
|---|---|---|---|
| BE | 1007274 | A5 | 5/1995 |
| EP | 0377235 | A1 | 7/1990 |
| GB | 2344127 | A | 5/2000 |
| WO | WO-95/03472 | A1 | 2/1995 |
| WO | WO-2006/087239 | A1 | 8/2006 |

OTHER PUBLICATIONS

Van Berlo, André, "Internatonal Search Report", for PCT/BE2010/000021, as mailed Jun. 28, 2010, 7 pages.

* cited by examiner

*Primary Examiner* — Kenneth L Thompson
(74) *Attorney, Agent, or Firm* — Winstead PC

(57) ABSTRACT

The invention relates to a device including an apparatus for measuring drilling or coring operation parameters using a bit attached to the end of a drill string, the measuring apparatus (10) being housed in a chamber (5) provided in a sleeve (1, 18) that is designed to be positioned between two drill pipes of the drill string or between the bit and a drill pipe of the drill string, or to form a coupling (18) for joining a cutting head (15) of the bit to a drill string, the chamber (5) leading into an axial channel (11) of the sleeve.

25 Claims, 6 Drawing Sheets

DEVICE INCLUDING AN APPARATUS FOR MEASURING DRILLING OR CORING OPERATION PARAMETERS, AND EQUIPMENT INCLUDING SUCH A DEVICE

BACKGROUND

1. Field of the Invention

The invention relates to drilling or coring installations, in particular for drilling oil wells.

The invention relates more particularly to a device intended to be associated with a drilling or coring installation, in order to monitor it, by means of measurements of well parameters.

2. State of the Art

Drilling and coring of wells are normally carried out by means of a drill bit which is connected to a drive motor, located on the surface, by means of a drill string. Progressively as the drill bit advances in the well, pipes are added to the drill string.

It is desirable to have available a maximum amount of data relating to the drilling or coring operations, particularly regarding the medium in which drilling is taking place and the behaviour of the drill bit and its cutting head. Data relating to the medium in which drilling is taking place include in particular the type of rock formation attacked, the composition of the drilling mud and the presence of oil or other fluids. Data relating to the drill bit and its cutting head include its instantaneous rotational velocity, the variations in rotational velocity, the position of the cutting head relative to the wall of the well being drilled, the variations in the rotational velocity and in the velocity of advance in the well, the lateral and axial impacts to which the drill bit is subjected and the precession motion of the drill bit (generally called "whirling" in the English-language literature).

These data or drilling parameters can be stored during the drilling or coring operation and used subsequently to analyse the problems which may have arisen during the drilling or coring operation (such as, for example, momentary and unexpected slowing of the penetration velocity of the cutting head in the rock formation or abnormally rapid wear of the cutting head) or to adapt the conditions of other drilling or coring operations.

To detect the data or parameters mentioned above, drilling installations are provided with suitable measurement equipment which is arranged in the drill string or in the drill head.

Thus, in document BE-1007274, a drill bit is described the cutting head of which contains judiciously distributed accelerometers to determine the vibrations to which it is subjected during a drilling operation. In this known drill bit, the accelerometers are positioned in the drill head, which makes the acquisition of the parameters only possible for this particular drill head thus equipped.

In document U.S. Pat. No. 4,303,994, a drilling installation is described including a drill bit, a drill string and measurement gauges, which are housed in the drill string. In this document, the measurement gauges are arranged in the upper part of the drill string but information is not provided as to the manner in which they are inserted in the drill string. The arrangement of the measurement gauges in the upper part of the drill string constitutes a disadvantage, as the measurements which they perform do not take into account distortions suffered locally by the lower part of the drill string between the measurement gauges and the drill bit. These distortions include in particular flexions and torsions the characteristics of which vary over time, during the advance of the drilling. There results a sometimes considerable discrepancy between the measurements read by the gauges and the true operating characteristics of the drill bit and of its cutting head. In addition the assembly of the measurement gauges is relatively long, so that it is normally impossible to position it between the drill bit and a downhole motor.

Moreover, the known measurement equipment, described in the above-mentioned documents is not generally standard, but must be adapted, in each case, to the drill bit or to the drill string used, which complicates the construction of these devices, forms an obstacle to mass production and increases the cost thereof.

The drilling installations described in documents GB-2 344 127 and WO-2006 087 239 partially overcome the disadvantages of the devices of documents BE-1007274 and U.S. Pat. No. 4,303,994. In these known installations, the measurement equipment is arranged in one or more chambers, formed at the periphery of couplings which are incorporated in the drill string of the drilling installation. This arrangement permits easy access to the measurement elements. However it presents various disadvantages, which are stated below.

A first disadvantage lies in the introduction, into the drill string, of a coupling of low mechanical strength. The coupling is in fact subjected to forces which can be large during a drilling operation, in particular axial compression or torsion forces, or else flexion moments. By hollowing out the peripheral zone of the coupling to form the chamber intended for the measurement equipment there, its mechanical strength is inevitably reduced. The torsion, as well as the flexion moments in fact act mainly on the outer fibres of the coupling. As these fibres are interrupted by the presence of the peripheral chamber, the torsion and flexion forces are channelled in the central part of the coupling, which has a smaller diameter, which exposes it to premature breakage.

In the installations of documents GB-2 344 127 and WO-2006 087 239 the low strength of the coupling in flexion and in torsion has the disadvantageous consequence of interfering with the proper functioning of the measurement equipment, leading to untimely modification of the behaviour of the drill string.

In these known installations, the coupling is in fact provided with an outer sheath, intended to obturate the chamber containing the measurement equipment. This sheath can absorb part of the forces which the measurement equipment has precisely the task of measuring. As a result the calibration of the measurement equipment is rendered difficult.

The presence of the sheath at the periphery of the coupling is the cause of another disadvantage of these known drilling installations. This sheath is in fact exposed to the drilling mud rising back in the annular zone situated between the drill string and the wall of the well. This drilling mud rising back along the drill string is charged with rock cuttings which have been extracted by the action of the drilling tool. In addition, since this sheath is exposed to the drilling fluid in the outer part of the device, it is subjected to the hydrostatic pressure from the drilling fluid, which can be high in the case of very deep wells. Consequently the sheath must be very thick in order to withstand this hydrostatic pressure.

During drilling, the sheath enters into contact with the wall of the well. It can therefore be damaged, be corroded, wear, become unscrewed, or be punctured. This can therefore result in malfunctioning of the device. This can also result in a great deal of difficulty when the sheath is removed for maintenance of the measurement equipment.

The sheath poses another problem during handling of the coupling and, more generally, of the drill string. It is in particular subjected to large torsional forces which can damage it, when screwing the coupling onto the drill string. This is particularly the case when the sheath is designed to minimise the absorption of forces in order to reduce its effect on the taking of measurements.

SUMMARY OF THE INVENTION

The invention is intended to remedy the drawbacks and disadvantages of the known measurement devices, described above.

The invention is more particularly intended to provide a self-contained measurement device, which can easily be detached from the drilling installation and recovered, in the event that the latter is damaged.

A further objective of the invention is to provide a measurement device which can be positioned in a drilling installation in such a way as to prevent a discrepancy between the measurements taken and the instantaneous characteristics of the drill bit and of its drill head.

An additional objective of the invention consists in providing a measurement device of standard construction, which can consequently be mass-produced and the cost of which will be reduced.

An additional objective of the invention consists in providing a sufficiently compact measurement device for it to be able to be arranged in the immediate proximity of the drill bit (or of its cutting head), between the latter and a downhole motor.

The invention is quite particularly intended to provide a measurement device of the type including measurement equipment in a coupling intended to be incorporated in a drill string, which avoids the disadvantages of the known devices described above. More particularly, the invention is intended to provide an improved device of this type, in which the coupling has high mechanical strength, does not interfere with the proper functioning of the components of the measurement equipment and for which the risks of deterioration by screwing tools are minimised, during assembly of the elements of the drill string. Due to its high strength, the device can optionally be positioned right at the start of the drill string, just below the rotary drive motor, situated at the surface.

Consequently, the invention relates to a device including measurement equipment for monitoring a drilling or coring operation by means of a drill bit fixed to the end of a drill string, said device including a coupling which is designed to be interposed between two pipes of the drill string or between the drill bit and a pipe of the drill string or between a first pipe of the drill string and a driving organ of said drill string and which includes at least one chamber containing the measurement equipment; according to the invention, the device is characterised in that the chamber opens into an axial channel of the coupling.

In the installation according to the invention, the drill bit is not critical and can be any known drill bit, commonly used for the coring or drilling of mine shafts, oil wells, gas wells or artesian wells. The drill bit normally includes, in the usual manner, a cutting head and a connection, fixed to the cutting head. The connection is intended to fix the drill bit to the tip of a drill string.

By definition, the cutting head includes the cutting tools intended to attack the rock of the well during drilling. The cutting tools are not critical for the invention and may include fixed tools or rotary cutters or associate fixed tools and rotary cutters. Examples of fixed tools are those known in the drilling art by the names "PDC tools" (or "Polycrystalline Diamond Compact" in the English-language literature), TSD (or "Thermally Stable Synthetic Diamond" in the English-language literature) and "Impregnated".

The connection carries the cutting head and includes an organ for detachable coupling to a drill string. The coupling organ is advantageously standardised, for example in accordance with the API (American Petroleum Institute) standard, although this is not essential to the definition of the invention.

The drill string acts as a mechanical connection between the drill bit, situated at the bottom of the well, and a motor. The latter can be a downhole motor or a motor situated on the surface. The drill string is normally formed of an assembly of pipes. The pipes are normally assembled one after the other, during the advance of the drill bit in the well during drilling. It can be vertical, slanting, horizontal, curved or have any other shape suited to that of the well to be drilled. To join the pipes together, they are provided with coupling organs which are generally standardised. These coupling organs usually include threaded tips which are screwed into corresponding tapped tips. They are advantageously in accordance with the API (American Petroleum Institute) standard.

The measurement equipment serves to read and measure drilling parameters, such as the instantaneous rotational velocity of the drill bit and its variations in velocity over time, the position of the drill bit in the well, the mechanical forces to which it is subjected in the well, in particular the magnitude and the direction of the axial and lateral stresses on contact with the wall of the well, and the electrical conductivity of the drilling muds (exemplary and non exhaustive list). The measurement equipment is not critical to the definition of the invention and may in particular include accelerometers, magnetometers, thermometers, manometers, electrodes for measuring electrical resistance, mechanical stress gauges or any other gauges for measurement of physical or chemical magnitudes commonly used in measurement equipment for well drilling or coring installations. Additional data relating to the measurement equipment which can be used in the device according to the invention can in particular be obtained from documents BE-1007274 and EP-0377235. The measurement equipment may include a self-contained recording device. By way of an alternative, it may be connected to a recording and analysis device situated on the surface.

By definition, within the framework of the present invention, the expression "measurement equipment" incorporates the electrical supply circuit of the measurement gauges of said measurement equipment. This electrical supply can include one or more electric batteries or one or more electric accumulators, as well as electronic components normally required for the operation of the measurement gauges.

The measurement equipment is housed in at least one chamber formed in a coupling and the latter is designed to be interposed between two pipes of the drill string or between the drill bit and a pipe of the drill string or between a first pipe of the drill string and a driving organ of said drill string.

In the device according to the invention, the driving organ is, by definition, situated upstream of the drill string, as opposed to the drill bit which, by definition, is situated downstream of said drill string. The first pipe is consequently, by definition, the upstream pipe of the drill string.

The driving organ is not critical for the definition of the invention and can be any conventional motor normally used in well coring or drilling installations. It is usually situated on the surface of the ground.

The coupling is a mechanical joining piece, which is designed to provide the mechanical connection between two pipes of the drill string or between a pipe of the drill string and the drill bit or between the first pipe of the drill string and the driving organ mentioned above. It is consequently equipped with a coupling organ to the drill string. Details relating to this coupling organ will be given below.

The coupling may have any form compatible with its insertion in the drill string or between the latter and the drill bit. Its dimensions must obviously be compatible with its passage in the well, without opposing drilling and the advance of the drill bit in the well. It is preferably cylindrical.

The chamber formed in the coupling must have sufficient dimensions to accommodate the measurement equipment. It may be a single chamber or two or more chambers.

According to a first characteristic of the invention, the coupling has an axial channel. The axial channel is generally rectilinear. It can advantageously be used for the circulation of a drilling fluid, in particular a drilling mud or liquid and it is then designed to be arranged in the extension of the corresponding axial channels of the drill string.

According to a second characteristic of the invention, the above-mentioned chamber of the coupling has an opening which emerges in the axial channel.

The diameter of the axial channel of the coupling and the dimensions of the above-mentioned opening of the chamber must be compatible with the dimensions of the components of the measurement equipment, so that these can be introduced into the chamber via said axial channel and said opening. Notwithstanding this condition, the form and the dimensions of the opening of the chamber of the coupling are not critical for the definition of the invention.

The radial depth of the chamber of the coupling must be sufficient to contain the components of the measurement equipment. However it cannot exceed a critical value which would weaken the mechanical strength of the coupling. As a general rule, the optimum radial depth of the chamber will be conditional upon the outer diameter of the coupling, in such a way that the radial thickness of the coupling between its outer peripheral face and the chamber is sufficient to guarantee a sufficient mechanical strength for the coupling during normal use of the latter in a drilling installation.

In the remainder of this document, the outer peripheral face of the coupling is its face which, on using the coupling in a drilling installation in a well, faces the wall of the well. Conversely, the inner face of the coupling is that which defines the axial channel of the coupling.

Optionally, there may be an inspection hole through the coupling, from its outer peripheral face, communicating with the chamber. Where necessary, the dimensions of the inspection hole must be sufficiently small not to substantially affect the mechanical strength of the coupling. In practice, it is preferred that the chamber containing the measurement equipment does not have access to the outer peripheral face of the coupling.

In the device according to the invention, the above-mentioned opening of the chamber containing the measurement equipment must be obturated. This obturation may be effected by any suitable means capable of creating an hermetic obturation and of withstanding the pressure of the drilling fluid during normal use of the drilling installation. This means may be non-removable and include a panel welded or bonded onto the inner face of the coupling. According to the invention, a removable obturation means is preferred.

In the device according to the invention, the coupling and the chamber containing the measurement equipment are advantageously so conformed as to prevent the formation of an imbalance when the coupling, loaded with the measurement equipment, is incorporated in the drill string.

In an advantageous embodiment of the device according to the invention, the coupling is cylindrical and the chamber containing the measurement equipment includes a groove, which is arranged radially across its axial channel. In the case of a single chamber, the groove is preferably annular. Where the coupling includes a plurality of chambers, these can advantageously be formed in grooves which are uniformly distributed at the periphery of the axial channel of the coupling.

In the advantageous embodiment which has just been described, the obturation of the groove(s) can be effected by any suitable known means. According to the invention, a ring is preferably used, which is applied to the inner face (defined above) of the coupling, around its axial channel. The ring and its manner of fixing to the coupling must be designed to withstand the pressure of the drilling fluid.

The device according to the invention, according to the advantageous embodiment described above, has the advantageous feature of having high mechanical strength and rigidity because the measurement equipment assembly is housed in a single groove or in a limited number of grooves, positioned around the axial channel of the coupling. This arrangement in fact allows a large quantity of material (metal) to be kept at the periphery of the coupling, which gives it high mechanical strength. This high resistance to torsion, to flexion and to compression allows the device to be positioned at any location in the drilling string, from the drilling tool to the surface of the well. Such an arrangement has the additional advantage of facilitating handling of the device, during screwing or unscrewing of the coupling onto or from a drill string, since the coupling does not risk being damaged by the high drilling torques employed during such operations.

The device according to the invention, according to the advantageous embodiment described above has the advantageous feature of being compact and of small volume.

In a particularly preferred embodiment of the invention, components of the measurement equipment are superposed in the groove, in a transversal direction relative to the axis of symmetry of the coupling. All other things being equal moreover, this alternative embodiment of the invention increases the compactness of the device and reduces its volume. More generally, in this particular embodiment of the invention, the measurement equipment includes at least two components which are superposed in the groove.

In this document, the term "superposed" is considered in a radial direction of the coupling and of the groove. Of the two superposed components, the one which is most distant from the axis of rotation of the coupling is, by definition, above the other component.

In a particular embodiment of the alternative embodiment described above, one of the components is arranged in the bottom of the groove and the other component is placed on a rider which straddles the component arranged at the bottom of the groove. This embodiment of the invention facilitates the construction of the device and the optimum positioning of the measurement equipment in the groove.

In a preferred embodiment of the invention, the two components of the measurement equipment advantageously include at least one gauge for measurement of mechanical stress, which is arranged in the bottom of the groove and an electronic circuit which is arranged above the mechanical stress gauge. In this preferred embodiment of the invention, the gauge for measurement of mechanical stress is a measurement gauge, designed to measure a mechanical stress generated by a traction, compression, flexion or torsion force to which the coupling is subjected during its normal use in a drilling or coring installation. Such measurement gauges are well known in the art. Hereafter, for the sake of simplicity, the expression "mechanical stress gauge" will be used to designate a gauge for measurement of a mechanical stress.

In the preferred embodiment which has just been described, it is advantageous to house the mechanical stress gauge in a trough provided in the bottom of the groove. The groove and the trough are preferably annular.

In the preferred embodiment which has just been described, it is advantageous for the component which is arranged above the mechanical stress gauge to include an electrical generator, in addition to the electronic circuit. In this alternative embodiment of the invention, the electrical generator may for example include a set of batteries, which are held in a removable case. The batteries can be removably mounted in the case or embedded in a block of resin.

In a specially recommended alternative embodiment of the preferred embodiment described above, the electronic circuit is placed on a rider which straddles the mechanical stress gauge. This alternative embodiment of the invention facilitates the construction of the device and the optimum positioning of the measurement equipment in the groove.

In the device according to the invention, the measurement equipment may advantageously include, in addition to the mechanical stress gauge, additional measurement gauges, selected from accelerometers, magnetometers, thermometers, manometers and electrodes for measurement of electrical resistance.

In a particular embodiment which is intended to further reduce the risk of deterioration of the coupling during a screwing/unscrewing operation, a circumferential grooving is arranged across the outer peripheral face of the coupling, around the chamber containing the measurement equipment. In a modified embodiment, a network of longitudinal (parallel with the axis of the axial channel) and circumferential groovings is formed on the outer peripheral face of the coupling. In these two embodiments of the invention, the groovings have the function of protecting the coupling from marks which can be left by the jaws of the tightening spanners used for the screwing and unscrewing operations. These groovings are preferably superficial, typically characterised by grooving depths of 1 to 5 mm.

In an additional embodiment of the device according to the invention, on the outer peripheral face of the coupling are arranged vanes fitted with elements which withstand abrasion, which have the function of centring the coupling and the drill string in the drilling well.

As explained above, the coupling of the device according to the invention is designed to be inserted either between two pipes of the drill string and to connect them, or between a pipe and the drill bit and then connect them or between a first pipe of the drill string and a driving organ of the drill string. The coupling is consequently equipped with coupling organs designed to make these connections. These coupling organs may advantageously be of the type described above for joining the pipes of the drill string together and include a threaded end and a tapped end. They are advantageously standardised, for example according to the API (American Petroleum Institute) standard. In this embodiment of the invention, the threaded end of the coupling is intended to be screwed into a corresponding tapped end of one pipe of the drill string and its tapped end is intended to be screwed onto the corresponding threaded end of another pipe of the drill string or onto the threaded end of a connection of the drill bit.

Due to its high mechanical strength, the coupling (and the measurement equipment which it contains) may be arranged as required at any location along the drill string while minimising the risks of breakage of the coupling. This feature of the invention has the advantage that it allows additional measurement equipment to be inserted into the drill string at any time, for example to carry out additional measurements or to remedy an occasional deficiency of measurement equipment situated downhole during drilling. Due to its high mechanical strength, the device according to the invention henceforth allows measurement equipment to be arranged in the immediate proximity of the cutting head of the drill bit and of the cutting face, ideally between the drill bit and a downhole motor or any other drilling device permitting a direction change, such as the recent rotary drilling direction change systems ("Rotary Steering System" in the English-language literature).

The device according to the invention constitutes a standard piece for the insertion as required of measurement equipment in well drilling installations, at any suitable location in the immediate proximity of the drill bit or in the drill string. It may be mounted in the drill string singly or in multiple manner and it may, moreover, be recovered, together with its measurement equipment, to be used subsequently in another drilling installation.

In a particularly advantageous embodiment of the device according to the invention, the coupling is designed to be fixed directly and removably to the cutting head of the drill bit. In this embodiment of the invention, the coupling constitutes the connection of the drill bit to the drill string. One of the ends of the coupling includes a removable fastening member for fastening to the cutting head of the drill bit and its other end includes a standard coupling organ to a drill string. The member for fastening to the cutting head must be designed to ensure a rigid connection. To this end, the coupling may advantageously be bolted to the cutting head. The member for coupling to the drill string normally comprises, in the usual manner, a threaded tip, intended to be screwed into a corresponding tapped tip of a pipe of the drill string. It is advantageously standardised, for example according to the API (American Petroleum Institute) standard.

In the embodiment which has just been described, the use of bolts or screws for fastening the coupling onto the cutting head has the advantage of facilitating assembly and disassembly operations, which do not require special tooling and may consequently be performed directly on a work site. In fact, a simply screwed system of assembling the two parts would involve high tightening torques, requiring specialised machines.

The embodiment which has just been described has the advantage that the measurement equipment is situated in the drill bit, in the immediate vicinity of the cutting head and the drilling face of the well. All other things being equal, this results in optimum accuracy of the measurements performed, as these are not interfered with by local distortions of the drill string.

In the particularly advantageous embodiment which has just been described, the coupling of the device according to the invention forms an integral part of the drill bit.

The invention consequently also relates to a drill bit including, conventionally, a cutting head and a threaded connection to join it to a drill string, in which the threaded connection is a coupling according to the invention.

The invention also relates to a drilling and/or coring installation, including a drill bit and a drill string, the installation being characterised in that it incorporates a device according to the invention.

In the installation according to the invention, the device may be arranged between two pipes of the drill string or between a first pipe of the drill string and a driving device of said drill string, situated on the surface or between a pipe of the drill string and a connection of a cutting head of the drill bit. Although this is not essential to implement the invention, it is preferred that the device be arranged in the immediate vicinity of the drill bit.

In a preferred embodiment of the installation according to the invention, the drill bit with which it is equipped is a drill bit according to the invention, in which the device constitutes the connection of the cutting head to the drill string.

BRIEF DESCRIPTION OF THE FIGURES

Features and details of the invention will become apparent in the course of the following description of the attached figures, which represent some particular embodiments of the invention.

In the figures, the same reference numbers designate the same elements.

DETAILED DESCRIPTION OF PARTICULAR EMBODIMENTS

Figure 1:
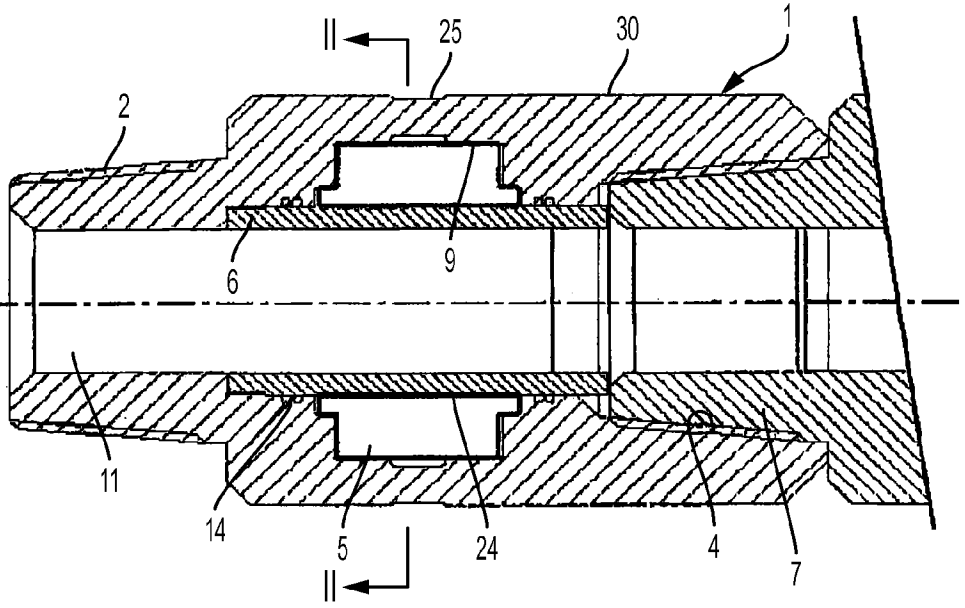
FIG. 1 shows a particular embodiment of the device according to the invention, in axial section.
Figure 2:
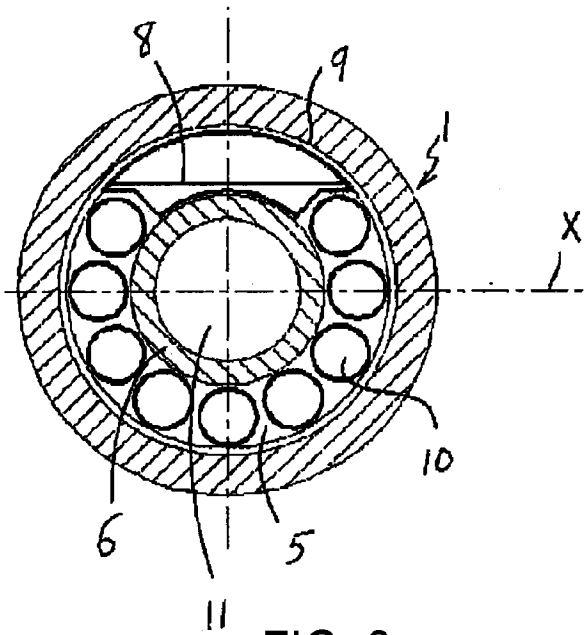
FIG. 2 is a section along the plane II-II of FIG. 1.

The device according to the invention, shown in FIGS. 1 and 2 includes a coupling 1 substantially of revolution about a rectilinear axis X. The coupling defines a cylindrical channel lithe axis of which coincides with the axis X. One end of the coupling 1 has a threaded tip 2 in the form of a truncated cone and the other end has a tapped tip 4 in the form of a truncated cone. The threaded tip 2 is designed to be screwed into a corresponding tapped tip of a pipe (not shown) of a drill string of a drilling or coring installation. The tapped tip 4 is designed to be screwed onto a corresponding threaded tip 7 of another pipe of the drill string or of the connection of a drill bit (not shown). The threaded 2 and tapped 4 tips conform to the API (American Petroleum Institute) standard.

Between its end tips 2 and 4, the coupling has a circular radial annular chamber 5, which is open facing the axial channel 11. The annular chamber 5 contains measurement equipment. This includes a measurement gauge (not shown) and a set of electric batteries or accumulators 10. The gauge is placed on a rider 8 which straddles the batteries 10 and which is fixed to the circular wall 9 forming the bottom of the circular annular chamber 5. The fixing of the rider 8 in the annular chamber 5 may be achieved by any suitable means, for example by means of screws (not shown). Placed and fixed to the rider 8, the gauge is thus situated between the rider and the bottom 9 of the annular chamber 5. The annular chamber 5 is obturated by means of a ring 6, screwed onto a corresponding screwed zone of the coupling 1. O-rings 14 seal the chamber 5.

The components of the measurement equipment must be configured and dimensioned to be able to pass through the axial channel 11 of the coupling and be introduced into the annular chamber 5. They must in addition be conformed and dimensioned not to hamper the positioning of the ring 6 used to obturate the chamber 5.

The measurement equipment is designed to read operating parameters of a drilling or coring operation. It may include more than one measurement gauge, the latter being able for example to include, in the usual manner, an accelerometer, a magnetometer, a thermometer, a manometer, an electrode for measurement of electrical resistance or a mechanical stress gauge (non-exhaustive list). The measurement equipment may also include an assembly of components and electronic circuits for recording and processing physical and, where appropriate, chemical magnitudes read by the measurement gauge or gauges. The chamber 5 may also include a regulating member (not shown) for automatically starting or placing on standby the measurement gauge(s). This regulating member, well known in the art, normally includes a clock and a detector of movement of the drill bit, which is programmed to read the state of movement or state of stress of the drill bit at predefined time intervals (for example its rotational velocity or a torque) and place the or each measurement gauge on standby while the drill bit is at rest or actuate it if the drill bit is in motion or subjected to stresses.

The axial channel 11 is extended in the tips 2 and 4 of the coupling 1. It is so dimensioned that, when the coupling 1 is mounted in a drill string of a drilling or coring installation, said axial channel 11 is arranged in the extension of the corresponding channels of the drill string and is then used for the circulation of a drilling or coring fluid. To ensure that it does not constitute an impediment to the circulation of the drilling fluid, the ring 6 is advantageously set flush in a recessed zone of the channel 11.

It is advantageous for the ring 6 to be extended as far as the tapped tip 4 of the coupling. In this manner, as soon as the coupling 1 is screwed onto the threaded tip 7 of an adjacent pipe of the drill string, this threaded tip 7 bears against the ring 6, preventing any displacement of the latter.

The coupling 1 is intended to be inserted between two pipes of the drill string of a drilling or coring installation or between the drill bit and the first pipe of the drill string. To this end, the threaded tip 2 of the coupling is screwed into a corresponding tapped tip of a pipe of the drill string and its tapped tip 4 is screwed onto the threaded tip 7 of the drill bit or of another pipe of the drill string.

It is advantageous to provide a circumferential grooving 25 at the periphery of the coupling 1, around the chamber 5. This grooving is intended to prevent the jaws of a grip from causing deterioration of the surface of the coupling around the chamber 5, upon screwing of the coupling onto a pipe of a drill string.

Figure 3:
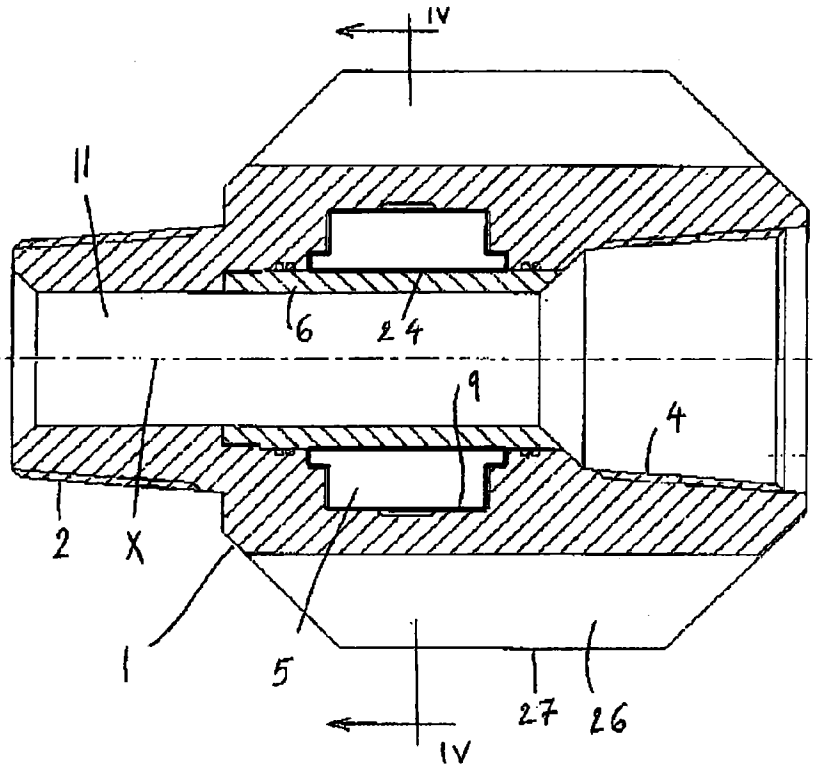
FIG. 3 shows a modified embodiment of the device according to the invention, in axial longitudinal section.
Figure 4:
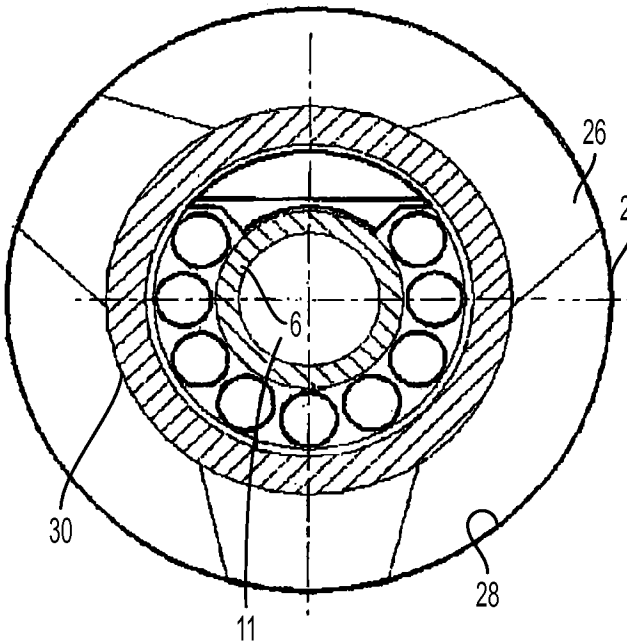
FIG. 4 is a section along the plane IV-IV of FIG. 3.

In the embodiment of FIGS. 3 and 4, the coupling 1 bears, at its periphery three radial vanes 26, the ridges 27 of which are fitted with abrasion resistant elements. These vanes 26 have the function of centring the coupling and the drill string in the drilling well 28.

Figure 5:
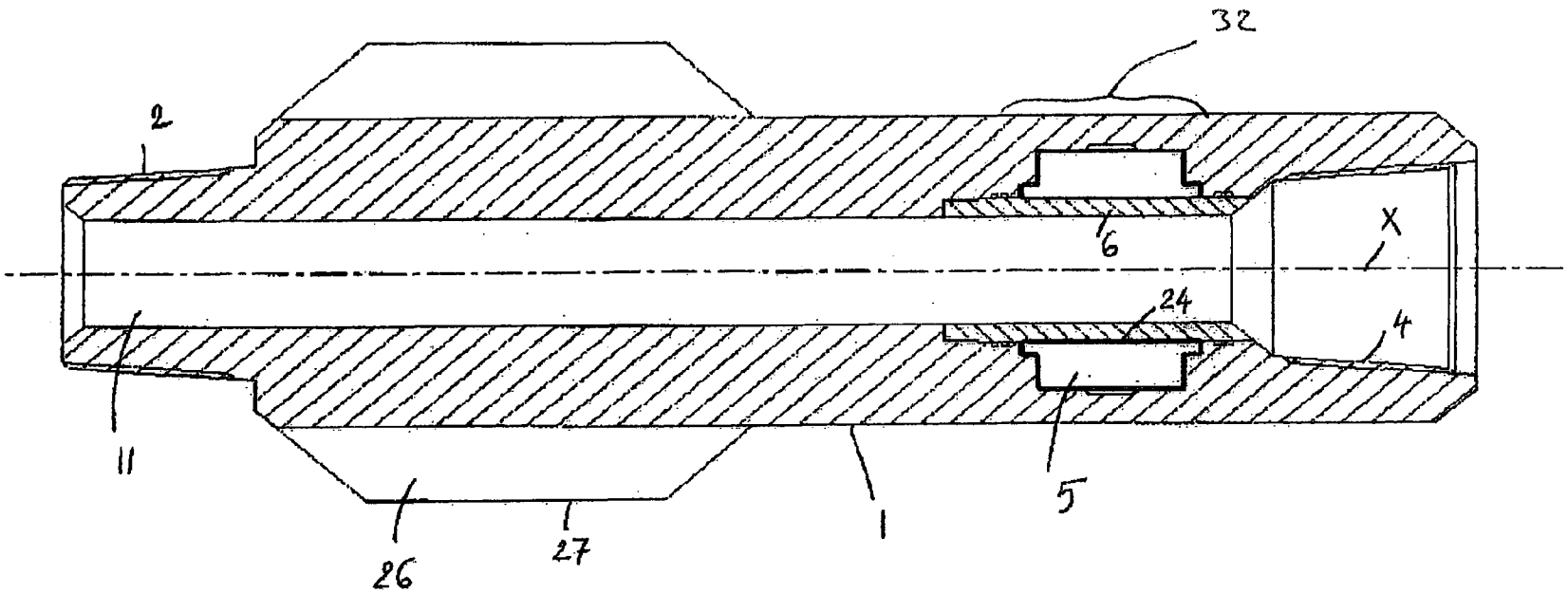
FIG. 5 shows an alternative embodiment of the device of FIG. 3.

In the alternative embodiment of FIG. 5, the vanes 26 extend over only a part of its peripheral face 30, preventing the zone 32 of the peripheral face, which surrounds the chamber 5, from being covered.

Figure 6:
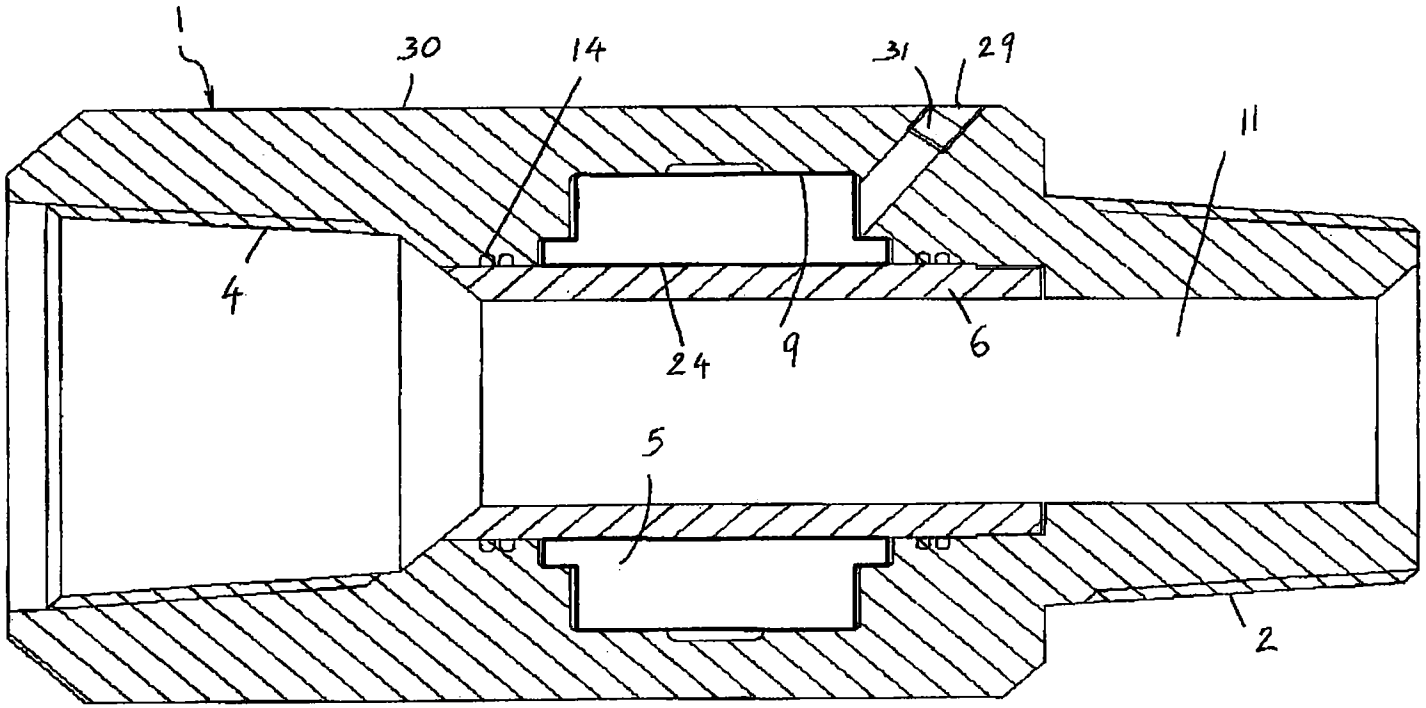
FIG. 6 shows, in axial longitudinal section, another modified embodiment of the device of FIGS. 1 and 2.

In the embodiment shown diagrammatically in FIG. 6, there is an inspection hole 29 through the coupling, from its outer peripheral face 30, in communication with the chamber 5. The inspection hole 29 emerges in a zone of the face 30 of the coupling which is not normally acted on by the tools used to screw the coupling onto the drill string. It is in addition of sufficiently small dimensions not to have an effect on the mechanical strength of the coupling. In practice, the diameter of the inspection hole 29 is very much smaller than the dimensions of the components of the measurement equipment and than the dimensions of the chamber 5, particularly of its opening 24. The inspection hole is normally hermetically obturated by a removable plug 31.

Figure 7:
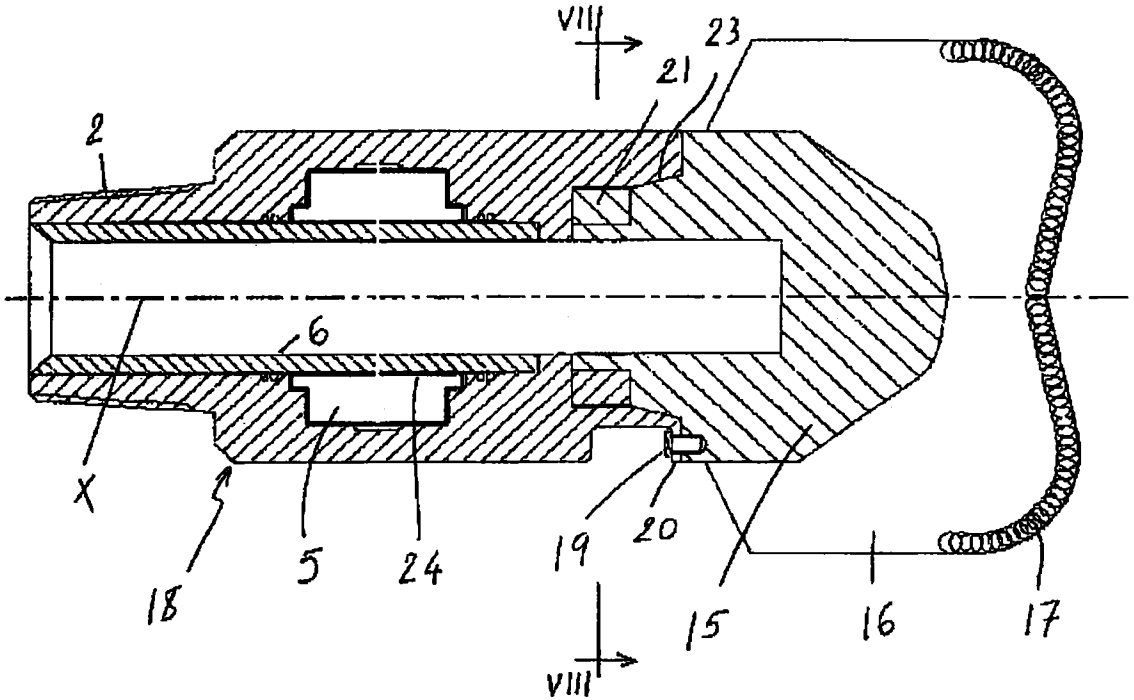
FIG. 7 shows a particular embodiment of the drill bit according to the invention, in axial longitudinal section.
Figure 8:
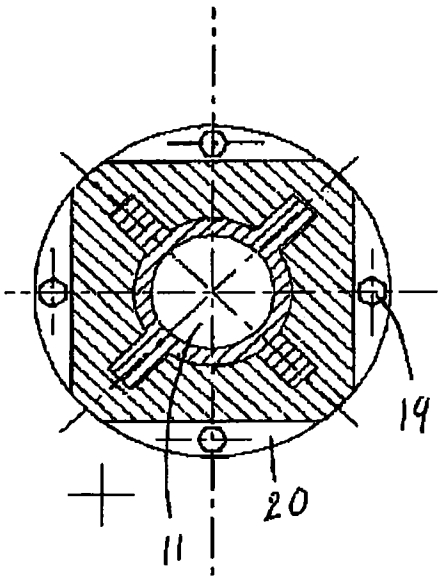
FIG. 8 is a section along the plane VIII-VIII of FIG. 7.
Figure 9:
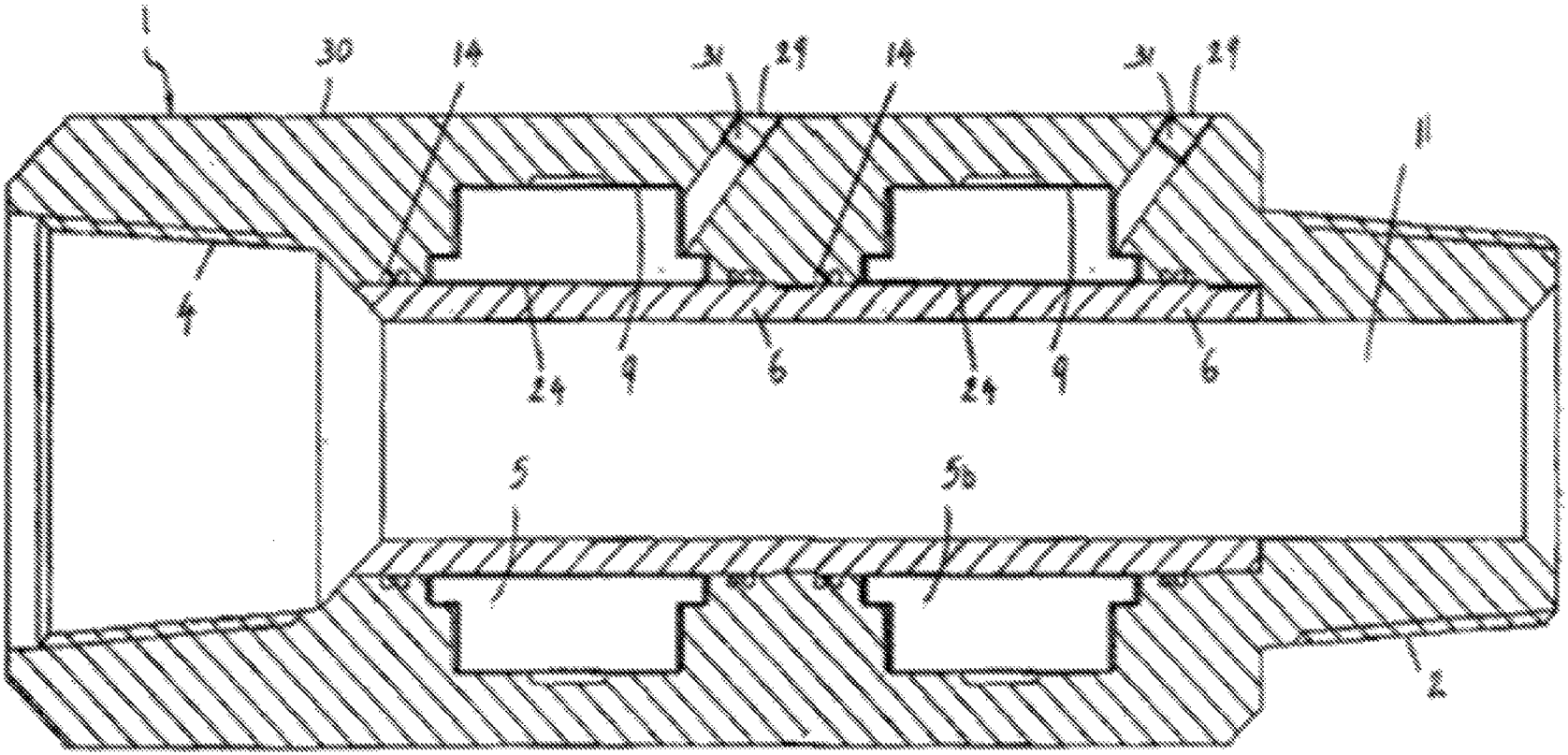
FIG. 9 shows an alternative embodiment of the device, in axial longitudinal section.

The drill bit according to the invention, shown in FIGS. 7 and 8 includes a cutting head 15 provided with longitudinal blades 16 bearing cutting tools 17. Cutting heads of this type are well known in the oil well drilling arts.

The cutting head 15 is fixed to a connection 18, by means of a screw ring 19 which passes through an annular flange 20 of the connection 18. An assembly of groovings and ribs 21 reinforces the fixing of the cutting head 15 to the connection 18 and a joint 23 in the form of a truncated cone reinforces the resistance of the assembly to flexion.

The connection 18 is tubular and a cylindrical axial channel 11 passes through it. It is provided, at its rear end, with a threaded tip 2 in the form of a truncated cone, intended to be inserted and screwed into a corresponding tapped tip of a pipe of a drill string. The connection 18 is of similar design to the coupling 1 described in FIGS. 1 to 3. Like it, it includes an annular chamber 5 to which there is access through an opening 24 in the axial channel 11 for introduction thereto of equipment 10 for measurement of operating parameters of a drilling or coring operation. Regarding this measurement equipment 10, what has been said above regarding the measurement equipment 10 of the device of FIGS. 1 and 2 may be repeated. A ring 6 hermetically obturates the opening 24 of the chamber 5.

The invention claimed is:

1. A device for measurement of parameters of a drilling or coring operation by means of a drill bit fixed to an end of a drill string, the device comprising:

a coupling, wherein the coupling is designed to be interposed between one of the following:

two pipes of the drill string;

a first pipe of the drill string and a driving device of the drill string, and the drill bit and a pipe of the drill string;

at least one annular chamber formed in an axial channel of the coupling, the at least one annular chamber defined by a pair of oppositely-disposed sidewalls, the at least one annular chamber having a first diameter and containing measurement equipment; and wherein the at least one annular chamber opens towards the axial channel of the coupling and contains gauges for measurement of at least one of physical and chemical magnitudes of the measurement equipment, the axial channel having a second diameter smaller than the first diameter.

2. Device according to claim 1, wherein the gauges for measurement are selected from accelerometers, magnetometers, thermometers, manometers, electrodes for measurement of electrical resistance and mechanical stress gauges.

3. Device according to claim 1, wherein the coupling is cylindrical and the at least one annular chamber is formed at a periphery of the axial channel.

4. Device according to claim 3, wherein the at least annular chamber is circular.

5. Device according to claim 3, wherein the coupling includes at least two annular chambers arranged uniformly at the periphery of the axial channel.

6. Device according to claim 3, wherein each annular chamber is obturated by a ring.

7. Device according to claim 6, wherein the coupling includes a tapped tip to fasten it to a corresponding threaded tip of a component of a drilling installation and in that the ring extends into the tapped tip.

8. Device according to claim 1, wherein a circumferential grooving is arranged across an outer peripheral face of the coupling, around the chamber containing the measurement equipment.

9. Device according to claim 3, wherein the measurement equipment includes at least two components which are superposed in the at least one annular chamber.

10. Device according to claim 9, wherein one of the components is arranged in a bottom of the at least one annular chamber and in that another component is placed on a rider which straddles the component arranged in the bottom of the at least one annular chamber.

11. Device according to claim 9, wherein the components of the measurement equipment include a measurement gauge and an electric accumulator.

12. Device according to claim 1, wherein the coupling bears radial vanes at its periphery, ridges of which are fitted with abrasion-resistant elements.

13. Device according to claim 12, the coupling comprises at least three radial vanes.

14. Device according to claim 12, wherein the vanes extend over only a part of an outer peripheral face of the coupling, without covering a zone of said outer peripheral face, which surrounds the chamber.

15. Device according to claim 1, wherein the coupling is designed to be fixed removably to a cutting head of the drill bit.

16. Device according to claim 15, wherein one end of the coupling includes a flange to fix it to the cutting head of the drill bit by means of screws or of an equivalent means, another end of the coupling including a threaded tip to fix it to a pipe of the drill string.

17. Device according to claim 1, wherein the coupling includes a threaded tip to fix it to a pipe of the drill string and a tapped tip to fix it to another pipe of the drill string or to a connection of the drill bit.

18. Device according to claim 1, wherein the measurement equipment is designed to measure an instantaneous rotational velocity of the drill bit, as well as an instantaneous magnitude and an instantaneous direction of lateral forces on the drill bit.

19. Device according to claim 1, wherein the chamber of the coupling also contains a regulating member for automatic starting or placing on standby of the measurement equipment.

20. Device according to claim 19, wherein the regulating member includes a clock and a detector of motion of the drill bit, which is programmed to read a state of movement or stress of the drill bit at predefined time intervals and put the equipment on standby while the drill bit is at rest or actuate it if the drill bit is in motion or subjected to stresses.

21. Device according to claim 20, wherein a state of motion or of stress includes at least one of a rotational velocity of the drill bit and a torque.

22. Drill bit including a cutting head fastened to a threaded connection to join it to a drill string, wherein the connection includes a coupling according to claim 16.

23. Drilling and/or coring installation including a drill bit and a drill string, wherein a drilling and/or coring installation incorporates a device according to claim 1.

24. Drilling and/or coring installation including a drill bit and a drill string, wherein the drill bit is according to claim 22.

25. A device for measurement of parameters of a drilling or coring operation by means of a drill bit fixed to a drill string, the device comprising:

a coupling, wherein the coupling is designed to be interposed between one of the following:

two pipes of a drill string;

a first pipe of the drill string and a driving device of the drill string; and the drill bit and a pipe of the drill string;

at least one annular chamber formed in an axial channel of the coupling, the at least one annular chamber defined by a pair of oppositely-disposed sidewalls, the at least one annular chamber having a first diameter and containing measurement equipment; and wherein the at least one annular chamber opens towards the axial channel of the coupling and contains measurement equipment of at least one physical and chemical magnitudes of the measurement equipment, the axial channel having a second diameter smaller than the first diameter and a third diameter smaller than the second diameter.

* * * * *